US005634634A

United States Patent [19]

Dobbertin et al.

[11] Patent Number: 5,634,634

[45] Date of Patent: Jun. 3, 1997

[54] VACUUM CORRUGATED DUPLEX TRAY HAVING OSCILLATING SIDE GUIDES

[75] Inventors: Michael T. Dobbertin, Honeoye; James D. Shifley, Spencerport; Robert A. Zimny, Brockport, all of N.Y.

[73] Assignee: Eastman Kodak Company, Rochester, N.Y.

[21] Appl. No.: 398,706

[22] Filed: Mar. 6, 1995

[51] Int. Cl.[6] ..... B65H 5/22; B65H 3/14; B65H 3/34; B65H 31/26

[52] U.S. Cl. ..... 271/3.02; 271/3.07; 271/94; 271/98; 271/104; 271/105; 271/106; 271/160; 271/161; 271/167; 271/209; 271/220; 271/221

[58] Field of Search ..... 271/3.02, 3.05, 271/3.07, 146, 94, 96, 98, 99, 104, 105, 106, 160, 161, 166, 167, 209, 220, 221, 222

[56] References Cited

U.S. PATENT DOCUMENTS

| | | | |
|---|---|---|---|
| 3,424,453 | 1/1969 | Halbert | 271/166 X |
| 3,947,018 | 3/1976 | Stange | 271/99 |
| 4,269,406 | 5/1981 | Hamlin | 271/108 |
| 4,270,746 | 6/1981 | Hamlin | 271/98 |
| 4,284,270 | 8/1981 | Silverberg | 271/166 |
| 4,299,381 | 11/1981 | Smith | 271/96 |
| 4,324,395 | 4/1982 | Silverberg | 271/98 |
| 4,336,928 | 6/1982 | Smith et al. | 271/3.1 |
| 4,336,929 | 6/1982 | Hanzlik | 271/20 |
| 4,411,417 | 10/1983 | Browne | 271/94 |
| 4,418,905 | 12/1983 | Garavuso | 271/98 |
| 4,462,586 | 7/1984 | Brown et al. | 271/94 |
| 4,526,359 | 7/1985 | Garavuso | 271/94 |
| 4,550,903 | 11/1985 | Moore | 271/98 |
| 4,560,158 | 12/1985 | Wilson | 271/165 |
| 4,566,683 | 1/1986 | Moore | 271/98 |
| 4,579,330 | 4/1986 | Lehmann | 271/11 |
| 4,627,606 | 12/1986 | Moore | 271/98 |
| 4,632,377 | 12/1986 | Browse | 271/9 |
| 4,678,175 | 7/1987 | Arldt et al. | 271/161 X |
| 4,813,660 | 3/1989 | Dodd et al. | 271/11 |
| 5,048,813 | 9/1991 | Wierszewski et al. | 271/98 |
| 5,050,853 | 9/1991 | LaVos et al. | 271/98 |
| 5,071,110 | 12/1991 | Arnone et al. | 271/104 |
| 5,088,713 | 2/1992 | Hayashi | 271/3.1 |
| 5,088,717 | 2/1992 | Hamanaka et al. | 271/98 |
| 5,110,113 | 5/1992 | Kanaya | 271/241 |
| 5,176,373 | 1/1993 | Namba | 271/3.1 |
| 5,181,711 | 1/1993 | Spoorenberg | 271/98 |
| 5,255,905 | 10/1993 | Reid et al. | 271/94 |
| 5,275,393 | 1/1994 | Cromie | 271/98 |
| 5,295,676 | 3/1994 | Kenin et al. | 271/94 |

FOREIGN PATENT DOCUMENTS

| | | | |
|---|---|---|---|
| 254431 | 11/1986 | Japan | 271/221 |
| 185797 | 8/1988 | Japan | 271/161 |
| 2237267 | 5/1991 | United Kingdom | 271/221 |

*Primary Examiner*—Boris Milef
*Attorney, Agent, or Firm*—Lawrence P. Kessler

[57] ABSTRACT

A device for transporting material, in the form of discrete sheets, seriatim to a stack of discrete sheets, and subsequently seriatim away from such stack. The discrete sheet material transport device comprises a support for a stack of discrete sheets. The stack support includes a first stop for a first marginal edge of a discrete sheet, and opposed second and third stops for opposed marginal edges of a discrete sheet perpendicular to the first marginal edge of such discrete sheet. Discrete sheets are delivered seriatim to the vicinity of the stack support and are urged in a first direction into engagement with the first stop to form a stack of discrete sheets on the stack support. The discrete sheets are subsequently urged seriatim in a direction opposite the first direction to remove discrete sheets seriatim from the stack on the stack support. The second and third stops are located to accurately position the stack of discrete sheets on the stack support. Further, the second and third stops are substantially simultaneously oscillated to maintain such stack in the accurate position as such discrete sheets are urged to and from the stack on the stack support.

10 Claims, 8 Drawing Sheets

VACUUM CORRUGATED DUPLEX TRAY HAVING OSCILLATING SIDE GUIDES

BACKGROUND OF THE INVENTION

The present invention relates in general to sheet feeding devices for reproduction apparatus for example, and more particularly to a receiver sheet feeding device, including a vacuum corrugated duplex tray in the duplex path of a reproduction apparatus, which utilizes a combination of vacuum and air pressure to accurately acquire, separate, and feed such sheets.

In typical reproduction apparatus, such as copiers or printers for example, information is reproduced on individual cut sheets of receiver material such as plain bond paper or the like. Modem reproduction apparatus, which are capable of operating at very high speeds, have improved productivity by reproducing information on both sides of a sheet of receiver material, referred to as duplex copying. Duplex copying requires precise handling of the individual sheets of receiver material to reproduce information on the first side of each sheet, and then turn such sheet over to reproduce information on the opposite side thereof. Thus, such reproduction apparatus must include sheet feeding devices for handling receiver sheet material for rapid, reliable transport through complex travel paths within the severe environments found in the apparatus. Accordingly, the sheet feeding devices must operate to feed the receiver sheet material at the necessary high transport speeds without damage to the material, and with a minimum of stoppages due to misfeeds or multifeeds.

Devices for feeding receiver sheet material in reproduction apparatus are typically of two types, friction feeders or vacuum feeders. Friction feeders, under normal conditions, are very reliable in feeding sheets individually from a stack of sheets. However, they are particularly susceptible to misfeeds and/or multi-feeds when subject to the harsh environment found in the duplex path of reproduction apparatus. Furthermore, friction feeders have a tendency to cause undesirable marks to be left on the sheets being fed thereby. Vacuum feeders are more reliable for feeding sheets in harsh environmental conditions, but require precise complex control to assure pickup of single sheets (i.e., for prevention of misfeeds or multifeeds). Feeders relying solely on vacuum tend to be noisy, and as such are not always suitable for use in office settings.

A recent patent, U.S. Pat. No. 5,295,676, (issued Mar. 22, 1994, in the name of Kenin et al), discloses a sheet feeding device combing the aspects of friction feeders and vacuum feeders. In the feeder of this patent, the bottommost sheet in a stack of discrete sheets supported on a tray is engaged by a friction belt which serves to remove the sheet from the stack. A vacuum source adjacent to the belt increases the force of engagement of the sheet with the belt to facilitate removal from the stack. Additionally, the sheet is caused to assume a slightly corrugated shape which facilitates separation of the sheet from the remainder of the sheets in the stack on the tray. This sheet feeding device has proven relatively successful in feeding sheets of receiver material in the duplex transport path. However, it is limited in the variety of receiver material which can be reliably handled, and is still subject to misfeeds and/or multi-feeds due to the harsh environmental conditions existing in the duplex transport path.

SUMMARY OF THE INVENTION

In view of the foregoing discussion, this invention is directed to a device for transporting material, in the form of discrete sheets, seriatim to a stack of discrete sheets, and subsequently seriatim away from such stack. The discrete sheet material transport device comprises a support for a stack of discrete sheets. The stack support includes a first stop for a first marginal edge of a discrete sheet, and opposed second and third stops for opposed marginal edges of a discrete sheet perpendicular to the first marginal edge of such discrete sheet. Discrete sheets are delivered seriatim to the vicinity of the stack support and are urged in a first direction into engagement with the first stop to form a stack of discrete sheets on the stack support. The discrete sheets are subsequently urged seriatim in a direction opposite the first direction to remove discrete sheets seriatim from the stack on the stack support. The second and third stops are located to accurately position the stack of discrete sheets on the stack support. Further, the second and third stops are substantially simultaneously oscillated to maintain such stack in the accurate position as such discrete sheets are urged to and from the stack on the stack support.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DETAILED DESCRIPTION OF THE INVENTION

Figure 1:
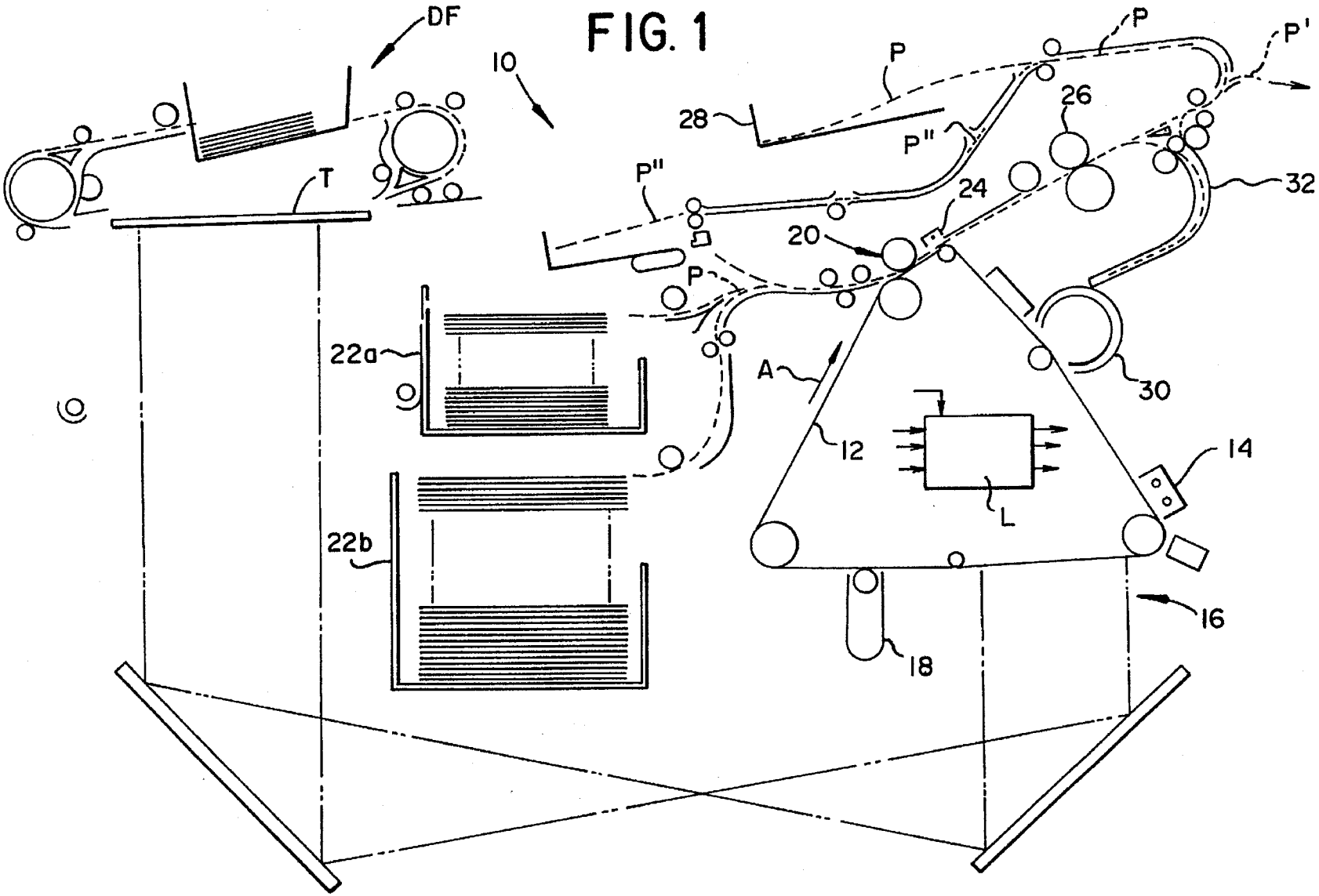
FIG. 1 is a generally schematic side elevational view of a typical reproduction apparatus incorporating the vacuum corrugated duplex tray according to this invention.

Referring now to the accompanying drawings, FIG. 1 schematically illustrates a typical electrostatographic reproduction apparatus 10, described herein only to the extent necessary for a complete understanding of the vacuum corrugated duplex tray according to this invention. The electrostatographic reproduction apparatus 10 includes a dielectric support member in the form, for example, of an endless web 12. The dielectric support member web 12 is mounted on support rollers and movable about a closed loop path in the direction of arrow A through a series of electrographic process stations.

In the operational cycle for the reproduction apparatus 10, the moving dielectric support member web 12 is uniformly charged in a primary charging station 14, for example as it moves past a corona charger. Thereafter, the uniformly charged dielectric support member passes through an exposure station 16 where the uniform charge is altered to form a latent image charge pattern corresponding to information desired to be reproduced. Depending upon the characteristics of the dielectric support member and the overall reproduction system, formation of the latent image charge pattern may be accomplished by exposing the dielectric support member to a light image reflected off of an original document to be reproduced. The original document to be reproduced is positioned on the transparent platen T of the reproduction apparatus 10 either manually or by any well known automatic document feeder, such as the recirculating document feeder DF schematically shown in FIG. 1. Alternatively, the latent image charge pattern may be formed by "writing" on the dielectric support with a series of lamps (e.g., LED's or lasers) or point electrodes activated by electronically generated signals based on the desired information to be reproduced.

The latent image charge pattern on the dielectric support member web 12 is the brought into association with a development station 18 which applies electroscopically charged pigmented marking particles to the dielectric support member to adhere thereto in order to develop the latent image charge pattern. The portion of the dielectric support member web 12 carrying the developed image then passes through a transfer station 20 in register with a receiver sheet fed in proper timed relation, from a receiver sheet supply hopper **22*a* or 22*b*, along the path P. An electric field produced in the transfer station 20** (for example by an electrically biased roller or a corona charger) attracts the pigmented marking particles of the developed image from the dielectric support member to the receiver sheet where the particles will adhere to the receiver sheet in an image-wise fashion.

The electric transfer field in the transfer station 20 may also cause the receiver sheet to adhere to the dielectric support member. Accordingly, a detack mechanism 24, immediately downstream in the direction of travel of the dielectric support member web 12, is provided to facilitate removal of the receiver sheet from the dielectric support member. The detack mechanism may be, for example, an AC corona charger for neutralizing the attractive field holding the receiver sheet to the dielectric support member web. After the developed image is transferred to the receiver sheet and the receiver sheet is separated from the dielectric support member, the receiver sheet is transported through a fusing device 26 where the image is fixed to the receiver sheet by heat and/or pressure for example. The receiver sheet bearing the fixed image is then transported along path P to be delivered to an output hopper 28 for operator retrieval, or along an alternate path P' to external finishing apparatus (not shown) associated with the reproduction apparatus 10. Simultaneously, the dielectric support member web 12 is cleaned of any residual marking particles at cleaning station 30 and returned to the charging station 14 for reuse.

Control of the reproduction apparatus 10 and the electrographic process stations are accomplished by a logic and control unit L including a microprocessor, for example. The microprocessor receives operator input signals and timing signals, for example, from sensors (not shown) detecting movement of the web 12 about its closed loop path. Based on such signals and a program for the microprocessor, the unit L produces signals to control the timing operation of the various electrographic process stations for carrying out the reproduction process. The production of a program for a number of commercially available microprocessors, which are suitable for use with the invention, is a conventional skill well understood in the art. The particular details of any such program would, of course, depend on the architecture of the designated microprocessor.

The reproduction apparatus 10 is constructed so as to be able to produce duplex copies; i.e., receiver sheets respectively bearing image reproductions on both sides thereof. The structure which enables duplex copies to be produced includes a vacuum corrugated duplex tray, according to this invention, designated generally by the numeral 40. The vacuum corrugated duplex tray 40 is located so as to selectively receive receiver sheets delivered from the path P to the tray via the path P", and selectively feed receiver sheets from the tray back into the path P upstream of the transfer station 20. Particularly, when it is desired to produce duplex copies, receiver sheets from the supply hopper **22*a* or 22*b* are fed seriatim to the transfer station 20 in timed relation to developed images carded by the dielectric support member web 12. At the transfer station 20, the developed images are transferred to a like oriented face of the receiver sheets respectively. Such receiver sheets are transported along the path P toward the output hopper 28. However, before being delivered to the hopper 28, such receiver sheets are diverted to the path P" for delivery to the vacuum corrugated duplex tray 40. At the appropriate time, the receiver sheets in the vacuum corrugated duplex tray 40 are returned to the path P in timed relation to developed images carded by the web 12. On return to the path P, the receiver sheets are oriented such that their respective faces which received developed images during the first pass through the transfer station 20 are directed oppositely to their direction on the first pass. Accordingly, on the second pass of such receiver sheets through the transfer station, developed images are respectively transferred to the opposite face of the receiver sheets. Of course, with the inclusion of a turn-over guide 32 in the path P, receiver sheets may be turned over such that their respective faces which received developed images during the first pass through the transfer station 20** are directed, when returned to the path P, in the same direction to their direction on the first pass. Accordingly, on the second pass of such receiver sheets through the transfer station, developed images are respectively transferred to the same face of the receiver sheets to form simplex copies with multiple images.

Figure 2:
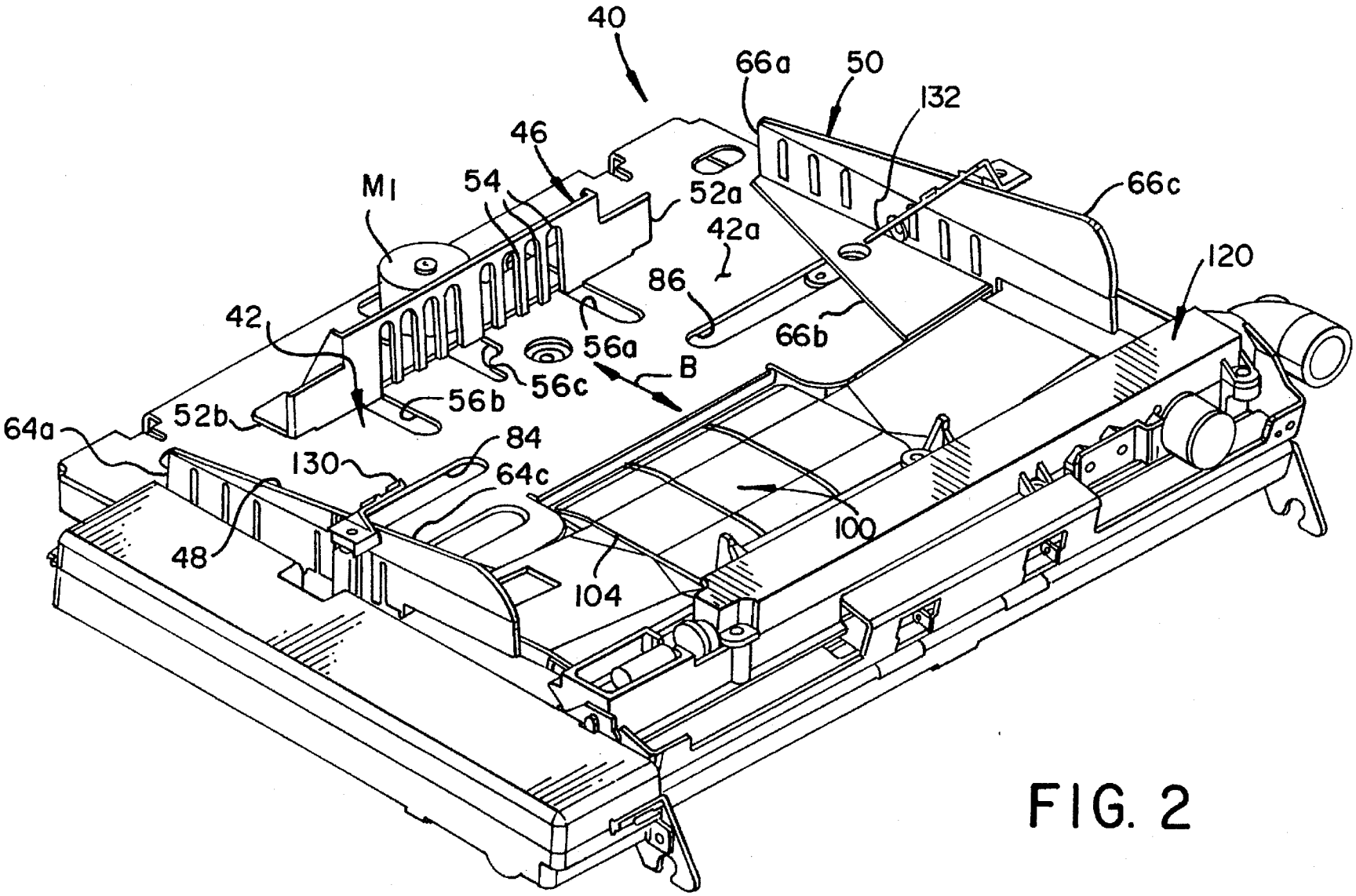
FIG. 2 is a view, in perspective, of the vacuum corrugated duplex tray according to this invention.
Figure 3:
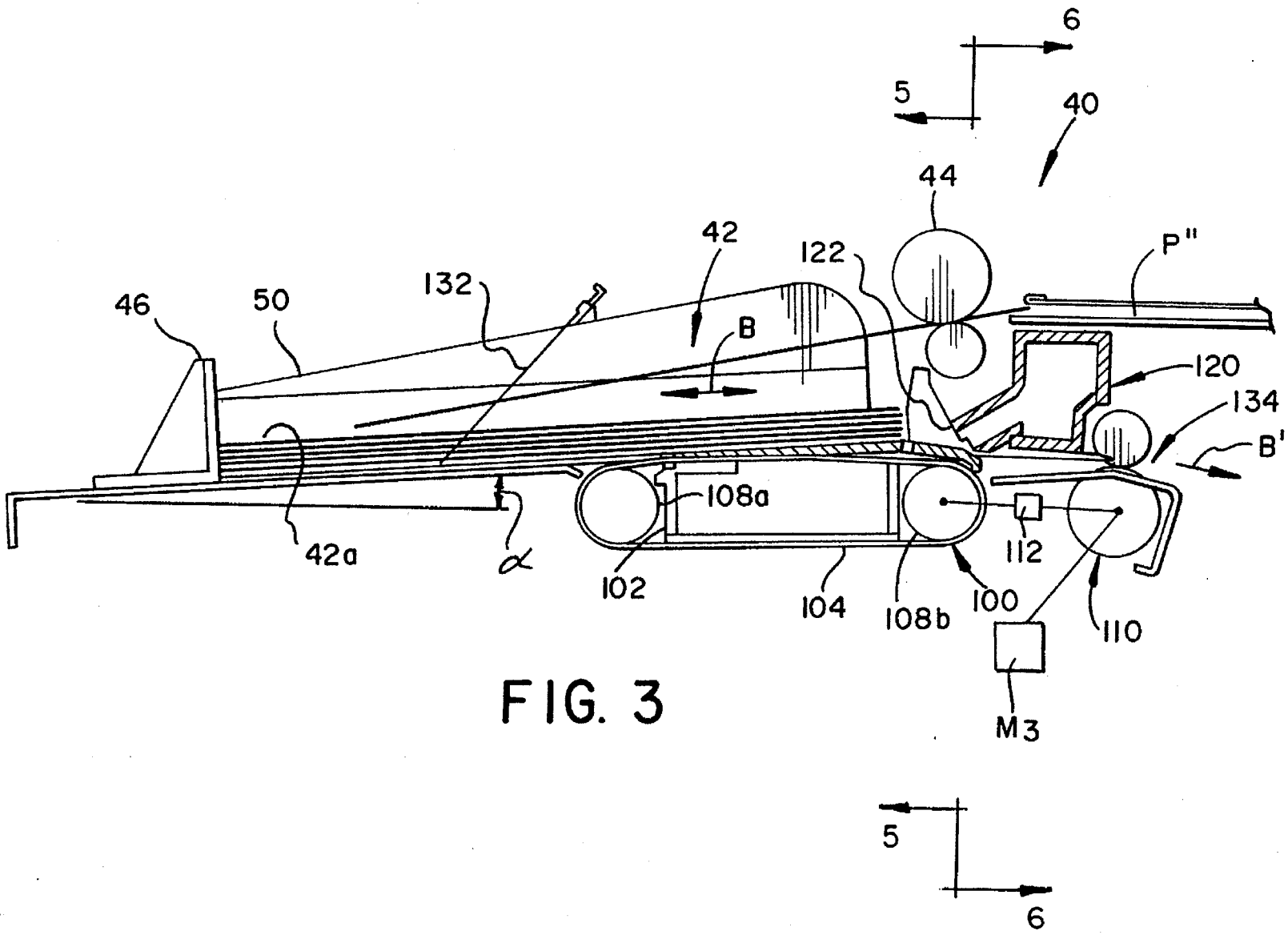
FIG. 3 is a side elevational view, in cross-section and on an enlarged scale, of the vacuum corrugated duplex tray as shown in FIG. 2.
Figure 4:
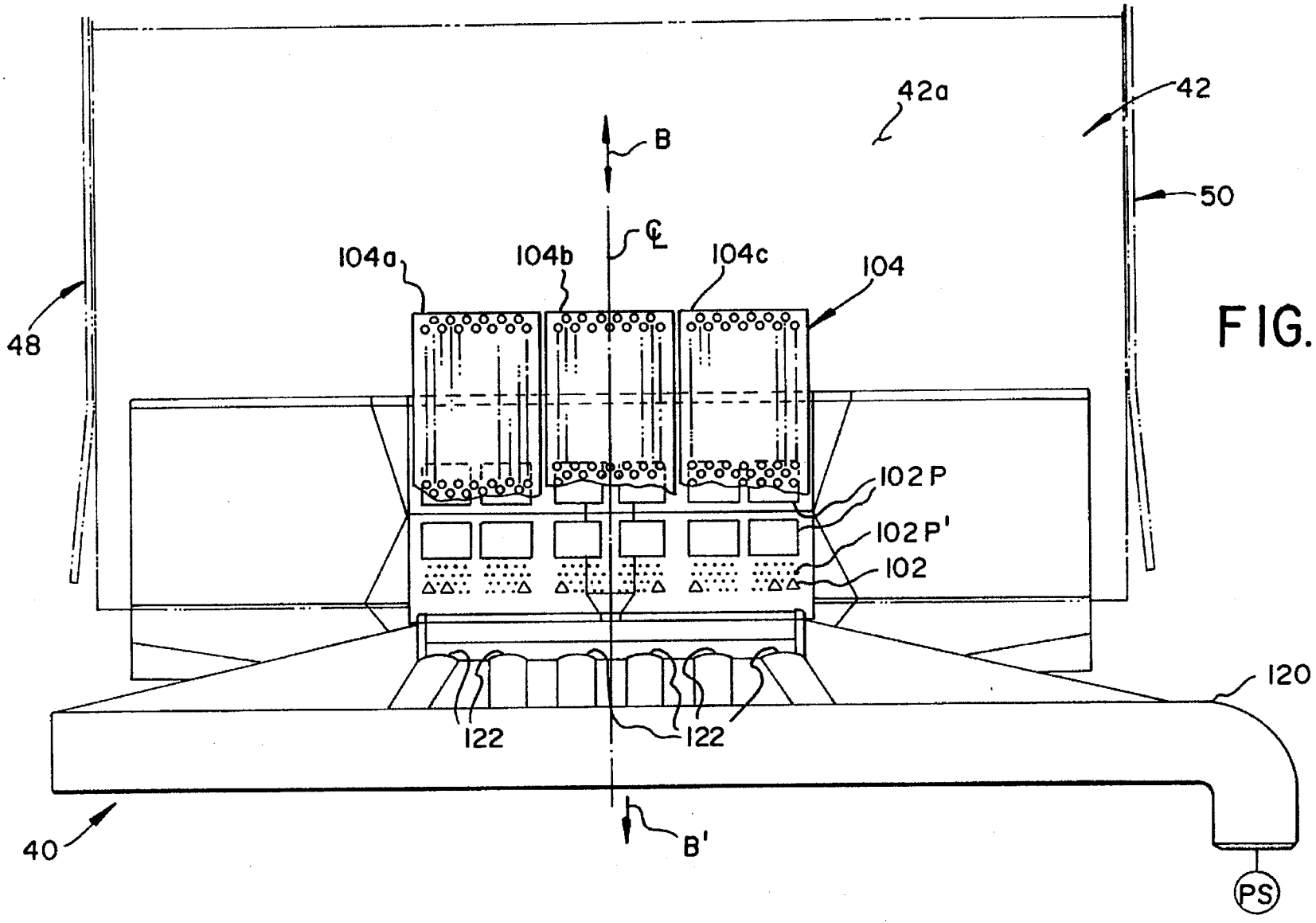
FIG. 4 is a top plan view of the vacuum corrugated duplex tray as shown in FIG. 2, with portions removed to facilitate viewing.
Figure 5:
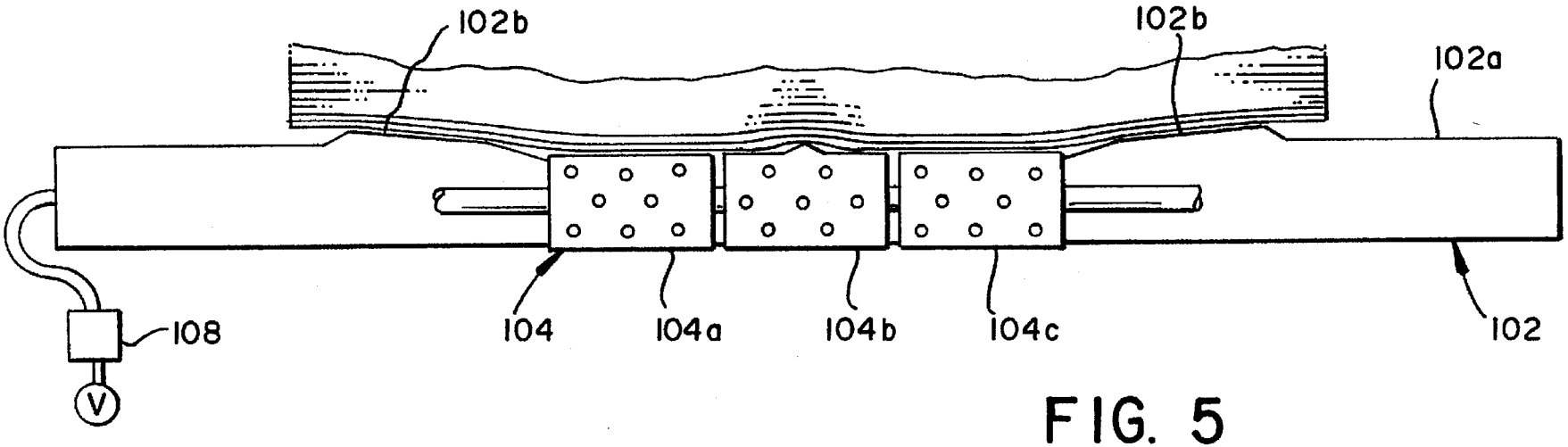
FIG. 5 is a front elevational view of the vacuum corrugated duplex tray as shown in FIG. 2, in cross-section, taken along the lines 5—5 of FIG. 3.
Figure 6:
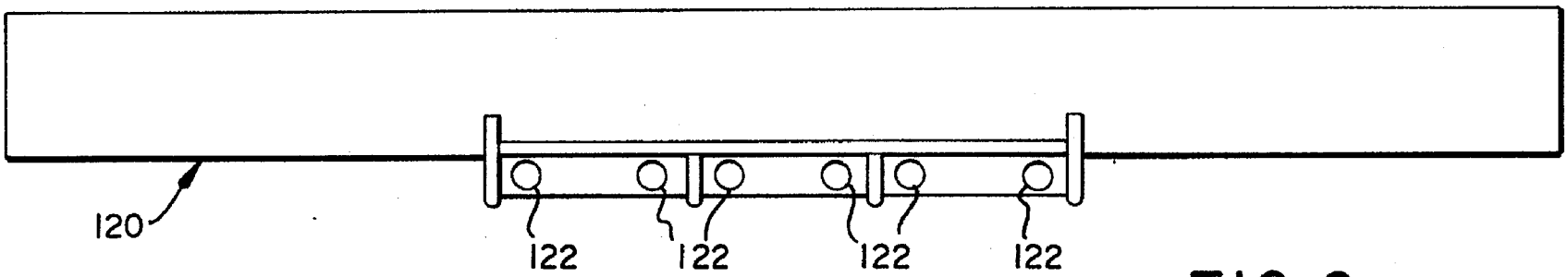
FIG. 6 is a rear elevational view of the air flow nozzles of the vacuum corrugated duplex tray as shown in FIG. 2, in cross-section, taken along the lines 6—6 of FIG. 3.

The vacuum corrugated duplex tray 40, according to this invention, is best seen in FIGS. 2–4. The vacuum corrugated duplex tray 40 includes an open hopper 42 located in the reproduction apparatus 10, generally above the receiver sheet supply hoppers 22*a*, 22*b*. The open hopper 42 has a platform surface 42*a* for supporting, in a stack, individual sheets of receiver material suitable, for example, for having reproductions formed thereon in the reproduction apparatus 10. The platform surface 42*a* is supported within the reproduction apparatus at an angle a (see FIG. 3) in the range of approximately 4°, measured from the horizontal. The receiver sheet sheets for receiving reproductions may be selected from a wide variety of materials and sizes. For example, the sheets may be of a weight in the range of 16 pound bond to 110 pound index, and a size in the range of 8×10 inches to 8.5×14 inches. As best seen in FIG. 3, a pair of nip rollers 44 is provided adjacent the exit from the path P" so as to deliver receiver sheets seriatim from the path P to the surface platform 42*a* of the hopper 42, along a direction of travel, indicated in FIGS. 2–4 by arrow B.

In order to enable the hopper 42 to accommodate the various sizes of receiver sheets, the hopper incorporates an adjustable guide 46 defining a first stop for a first common marginal edge of discrete receiver sheets. The guide 46 is disposed transverse to the direction B of sheet travel relative to the hopper 42. The hopper further incorporates adjustable guides 48 and 50 defining second and third stops for opposed common marginal edges of discrete receiver sheets, such opposed marginal edges being respectively perpendicular to the first marginal edge of a discrete sheet (and thus parallel to the direction B of sheet travel). The guides 46, 48, and 50 are thus arranged so as to be adjustable to engage the marginal edges of receiver sheets supported on the surface platform 42*a* in order to accurately locate the receiver sheets relative to a receiver sheet feed head assembly 100 (to be further explained hereinbelow).

Figure 7:
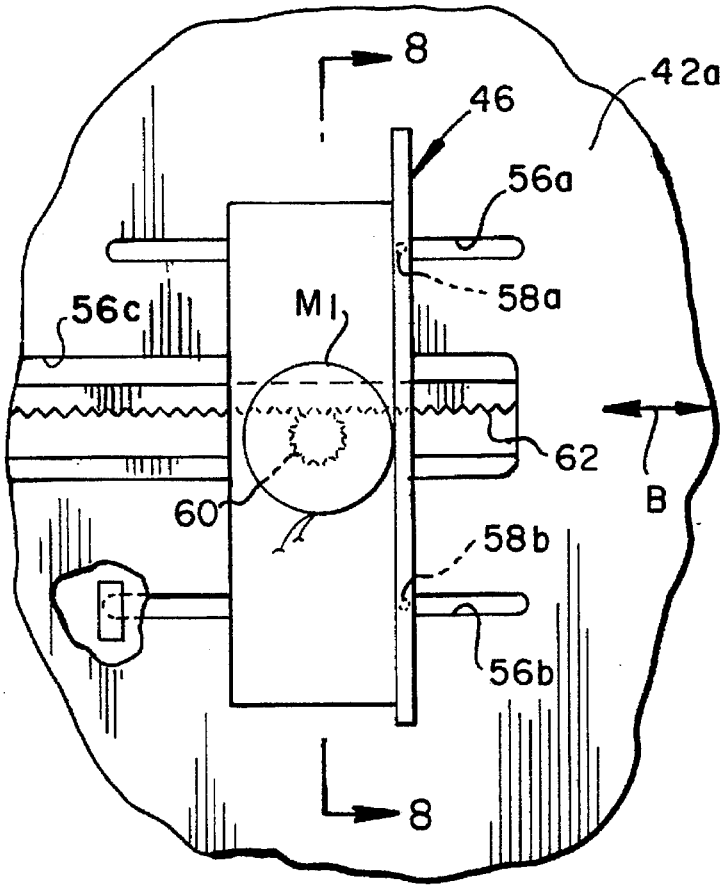
FIG. 7 is a top plan view of an adjustable marginal edge guide for the vacuum corrugated duplex tray as shown in FIG. 2, with portions removed to facilitate viewing.
Figure 8:
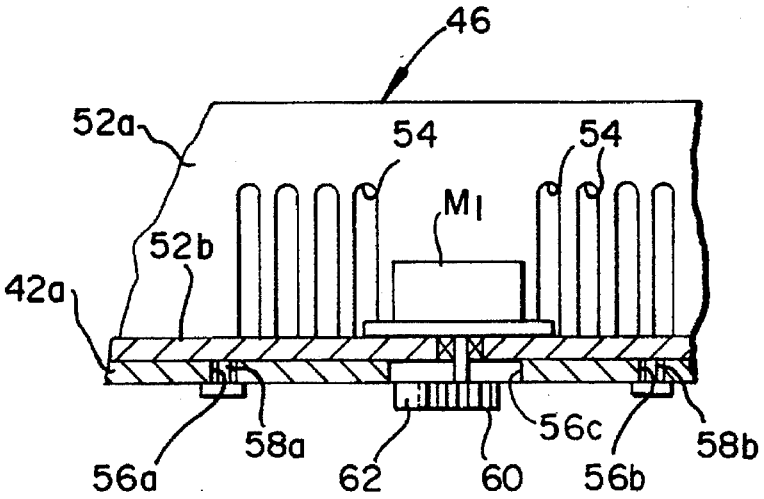
FIG. 8 is a cross-sectional, end elevational view of the drive for the adjustable marginal edge guide for the vacuum corrugated duplex tray, taken along lines 8—8 of FIG. 7, with portions removed to facilitate viewing.

The adjustable guide 46 includes a bracket having a generally L-shaped cross-section with an upstanding portion 52*a* and a base portion 52*b* (see FIGS. 7 and 8). The upstanding bracket portion 52*a* has a plurality of louvers 54. The louvers 54 enable free flow of sheet separating air through the portion 52*a* (as will be explained further below). The base portion 52*b* supports a stepper motor $M_1$. The stepper motor $M_1$ is connected to a control to effect adjustment of the guide 46, as desired, in the manner as will also be explained further below.

The surface platform 42*a* of the hopper 42 has a pair of elongated guide slots 56*a*, 56*b* extending therethrough, the slots being oriented so as to be parallel to the direction B of receiver sheet transport. A pair of pins 58*a*, 58*b* are attached to the underside of the base portion 52*b* of the bracket of the adjustable guide 46. The pair of pins 58*a*, 58*b* extend through the pair of guide slots 56*a*, 56*b* respectively, where enlarged heads of the pins retain the bracket on the surface platform 42*a* of the hopper 42 while enabling the bracket to be moved for adjustment relative to the hopper in the direction B of receiver sheet transport.

The surface platform 42*a* of the hopper 42 also has an additional elongated slots 56*c* extending therethrough, such slot being oriented so as to be parallel to the direction B of receiver sheet transport, and wide enough to accommodate a drive gear 60 mounted on the output shaft of the stepper motor $M_1$. The drive gear is in mesh with a rack 62 connected to the under side of the surface platform 42*a* of the hopper 42. As such, on an appropriate signal to the stepper motor $M_1$, the motor will cause the motor to step a predetermined number of steps in a desired direction to correspondingly rotate the gear 60. The gear will then walk along the rack 62 in the selected direction to cause the adjustable guide to move a desired distance and direction to set the guide at a desired position for properly locating receiver sheets delivered to the hopper 42 relative to the feed head assembly 100.

Figure 9:
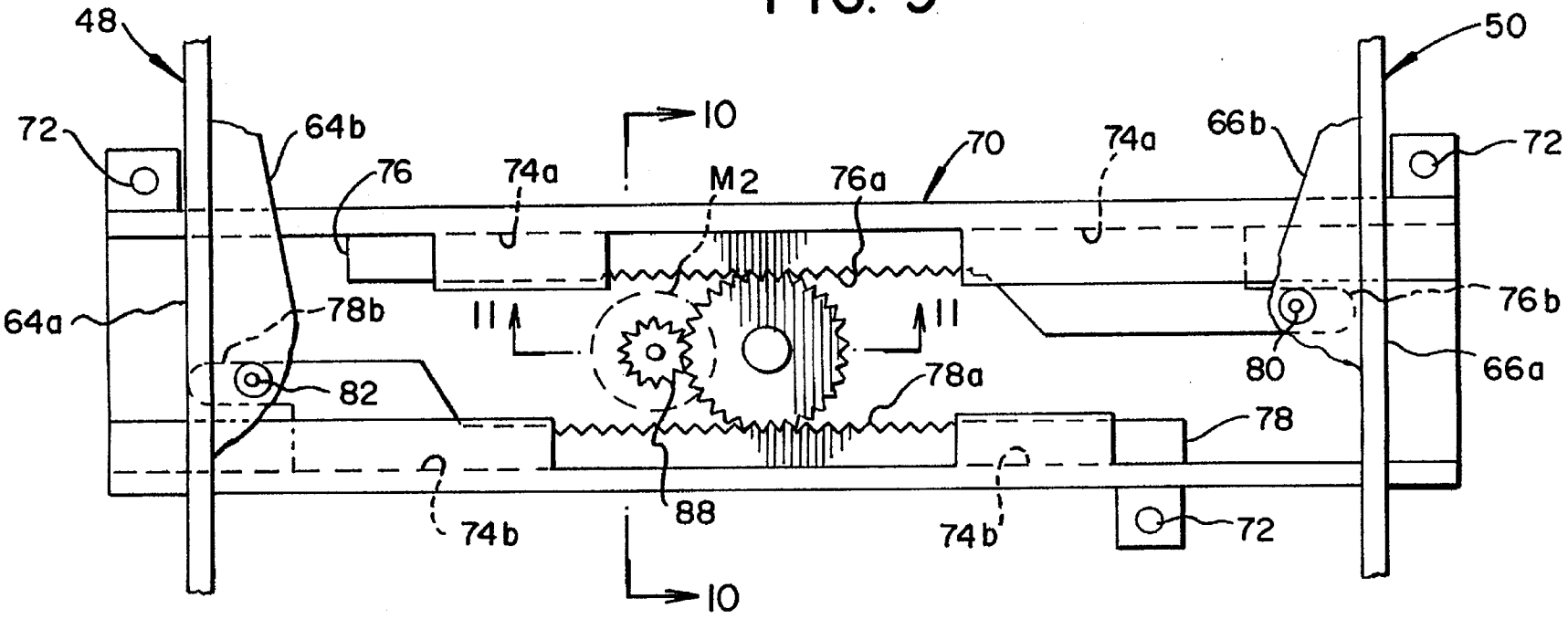
FIG. 9 is a top plan view of the drive for the opposed, adjustable, oscillating marginal edge guides for the vacuum corrugated duplex tray as shown in FIG. 2, with portions removed to facilitate viewing.

The adjustable guides 48 and 50 respectively include a bracket having a generally L-shaped cross-section with an upstanding portion 64*a*, 66*a*, and a base portion 64*b*, 66*b*, as best shown in FIGS. 2 and 9. The respective upstanding bracket portions 64*a*, 66*a* have an upper segment 64*c*, 66*c* which is flared in a direction so as to be widest at the end of the segment closest to the area of delivery of receiver sheets to the hopper 42. The flare of the upper segments 64*c*, 66*c* is for the purpose of facilitating the guide of receiver sheets delivered to the hopper 42, for proper location of receiver sheets to be stacked on the surface platform 42*a* of the hopper.

The adjustable guides 48 and 50 have danglers 130, 132 respectively attached thereto (see FIGS. 2 and 3) The danglers 130, 132 have a ramp-like configuration so as to serve to direct incoming receiver sheets delivered by the nip roller pair 44 to the surface platform 42*a* of the hopper 42. As such, the danglers prevent the opposed marginal edges of the receiver sheets in the sheet stack on the surface platform 42*a* from curling in a direction which would prevent the adjustable guides from acting to center the sheets on the stack. According to this invention, by the attachment of the danglers 130, 132, to the adjustable guides 48, 50 respectively, the danglers are always properly located relative to the opposed marginal edges of the receiver sheets in the stack irrespective of the position of the adjustable guides for any particular size sheet stack.

Figure 10:
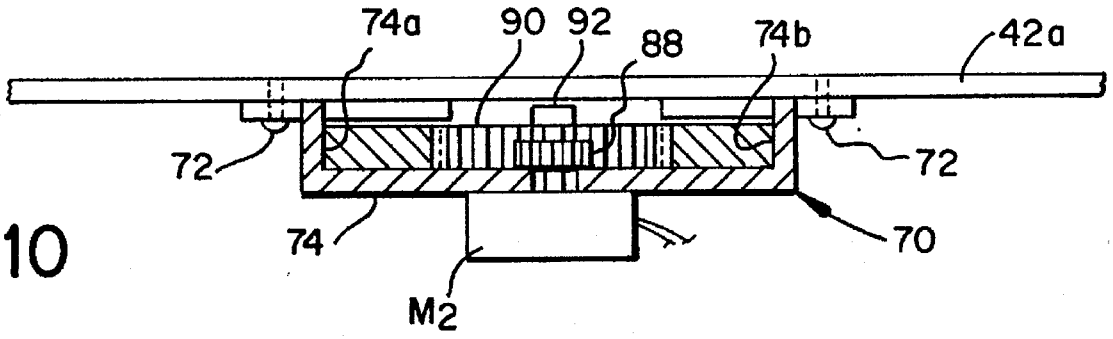
FIG. 10 is a cross-sectional, end elevational view of the drive for the opposed, adjustable, oscillating marginal edge guides for the vacuum corrugated duplex tray, taken along lines 10—10 of FIG. 9, with portions removed to facilitate viewing.

The respective base portions 64*b*, 66*b* of the brackets of the adjustable guides 48 and 50 are slidably supported on the surface platform 42*a* of the hopper 42. A traveling rack assembly 70 (as best shown in FIGS. 9 and 10) is adjustably attached to the underside of the surface platform 42*a*, by a plurality of studs 72, for drive association with the adjustable guides 48, 50 to control the movement thereof. The traveling rack assembly 70 includes an elongated housing 74 oriented in a direction such that the longitudinal axis of the housing is disposed to lie transverse to the direction B of receiver sheet transport. The housing 74 defines opposed channels 74*a*, 74*b* extending parallel to the longitudinal axis of the housing. Slide members 76, 78 are respectively supported for sliding movement within the channels 74*a*, 74*b*.

The respective slide members 76, 78 of the traveling rack assembly 70 have a rack segment 76*a*, 78*a* with the rack teeth of each segment facing each other. The respective slide members 76, 78 also include extension pieces 76*b*, 78*b*. The extension pieces 76*b*, 78*b* are respectively connected to the base portions 66*b*, 64*b* of the adjustable guides 50, 48 by pins 80, 82. The pins 80, 82 extend through respective slots 84, 86 in the surface platform 42*a*, such that the movement of the slide members 76, 78 is translated through the pins to the adjusting guides 48, 50 to cause corresponding movement thereof.

Figures 11, 12:
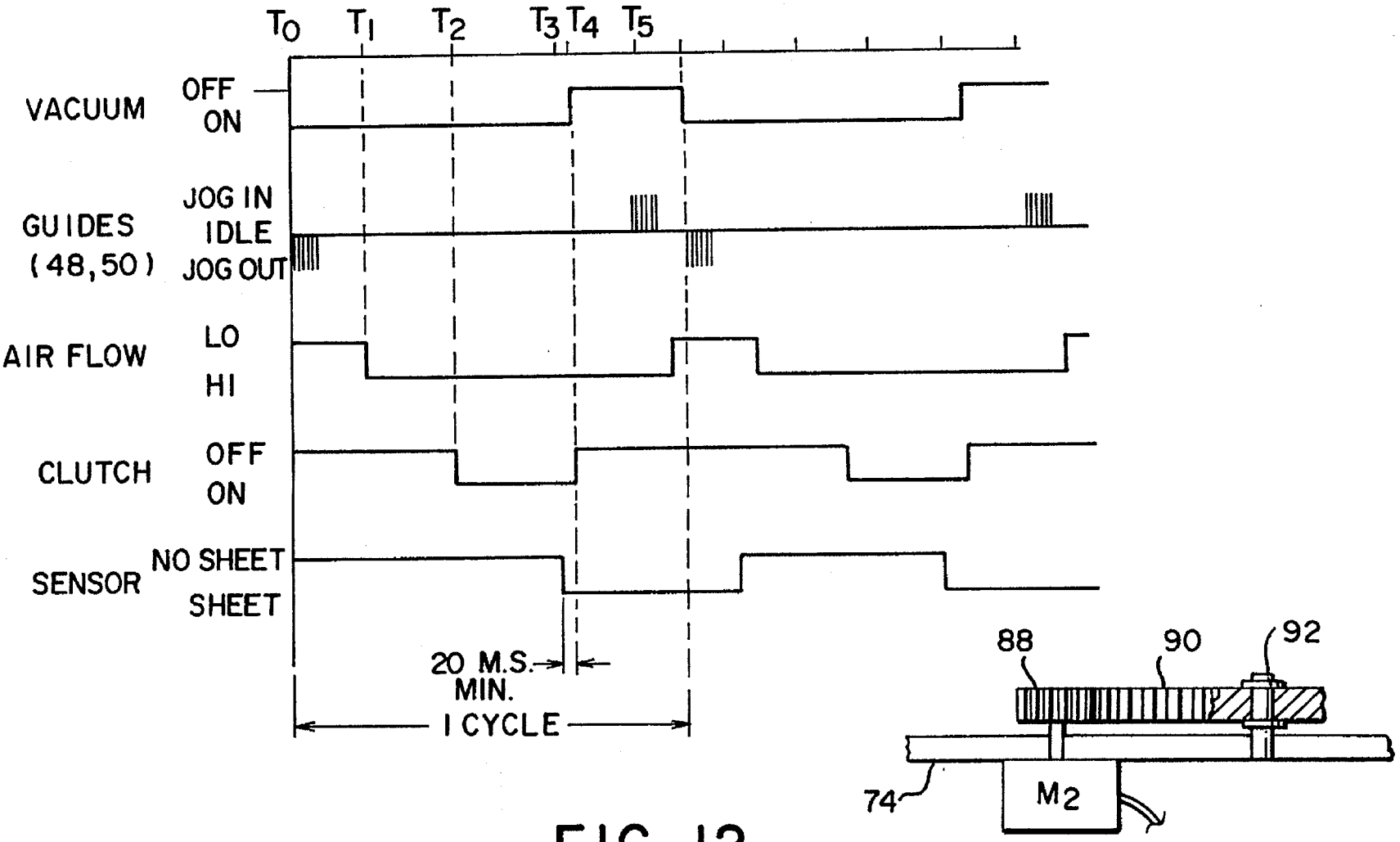
FIG. 11 is a cross-sectional, side elevational view of a portion of the drive for the opposed, adjustable, oscillating marginal edge guides for the vacuum corrugated duplex tray, taken along lines 11—11 of FIG. 9, with portions removed to facilitate viewing.
FIG. 12 is a graphical representation of a timing chart for the vacuum corrugated duplex tray, according to this invention.

In order to move the slide members 76, 78 of the traveling rack assembly 70, a stepper motor $M_2$ is mounted on the underside of the housing 74 of the traveling rack assembly. The stepper motor $M_2$ includes a drive gear 88 mounted on the output shaft of the motor. The drive gear 88, selectively rotated in either direction about its longitudinal axis, is in mesh with a gear 90. The gear 90 is particularly supported on a stud shaft 92 mounted on the housing 74 (best shown in FIG. 11) midway between the respective longitudinal axes of the slide members 76, 78. Such particular support of the gear 90 provides for free rotation of the gear about the longitudinal axis of the stud shaft 92, while preventing movement of the gear in the axial direction of the stud shaft, in any well known manner. Further, by selecting a particular diameter for the gear 90, the gear will mesh with both of the rack segments 76*a*, 78*a* of the slide members. Accordingly, when the stepper motor $M_2$ of the traveling rack assembly 70 is activated, the gear 88 is rotated in a desired direction, through a desired angle of rotation, to provide for corresponding rotation of the gear 90. Rotation of the gear 90 is translated into axial movement of the slide members 76, 78, and corresponding movement of the adjustable guides 48, 50. It can be readily seen that, by this arrangement, the traveling rack assembly 70 acts to move the adjustable guides 48, 50 like distances, in opposite directions, equally about the center line $C_L$ of the desired path for receiver sheets delivered to, or fed from, the hopper 42 in the direction B of receiver sheet transport path.

Therefore, the adjustable guide 46 for the first marginal edge of a discrete sheet, disposed transverse to the direction B of sheet travel relative to the hopper 42, and the adjustable guides 48 and 50 for opposed common marginal edges of discrete receiver sheets perpendicular to the first marginal edge of a discrete sheet, are readily adjustable by the motors $M_1$ and $M_2$ respectively to accurately position any selected size of receiver sheet on the surface platform of the hopper 42. A control may be provided where the size of a receiver sheet stack in the supply hopper 22*a* (or 22*b*) is determined, and based upon such determination, the motors $M_1$ and $M_2$ are activated to position the adjustable guides 46 and 48, 50 to accurately locate such size receiver sheet on the surface platform 42*a* when the receiver sheet is delivered to the hopper 42.

It should be noted that, according to this invention, the movement of the adjustable guides 48, 50 has a two-fold purpose. Firstly, the guides 48, 50 may be set at a position (referred to as the idle position) for accurately positioning a stack of receiver sheets on the surface platform 42*a* of the hopper 42, relative to the center line $C_L$. Secondly, the adjustable guides 48, 50 may be periodically oscillated by the motor $M_2$ and the traveling rack assembly 70 a predetermined distance from the idle position toward the center line $C_L$ for jogging the sheets in the stack to assure squareness of the stack, or away from the center line $C_L$ for permitting a delivered sheet to be directed onto the stack (and into engagement with the adjustable guide 46) with a minimum of drag on the sheet. During the jogging action of the adjustable guides 48, 50, the guides are moved sufficiently in the direction toward the center line $C_L$ to cause the receiver sheet stack to provide a buckle in the sheet stack. The buckle acts to further aid in separation of adjacent sheets to prevent multifeeds. Of course, the torque on the motor $M_2$ may be selected to stall the motor if the stack of sheets becomes too great.

As a result of the described adjustment for the adjustable guides 46 and 48, 50 to position receiver sheets delivered to the hopper 42, such receiver sheets are accurately located relative to the sheet feed head assembly 100 to be selectively fed seriatim from the hopper 42. The sheet feed head assembly 100 (as best shown in FIGS. 2–6) is located in association with the surface platform 42*a* of the hopper 42 so as to lie beneath a portion of the receiver sheet stack supported thereon adjacent to the marginal edges of the sheets opposite to the marginal edges in engagement with the adjustable guide 46. The sheet feed head assembly 100 includes a ported plenum 102 connected to a vacuum source V, and an air jet device 120 connected to a positive pressure air source PS. As will be more fully explained hereinbelow, a positive pressure air jet from the device 120 (adjustable relative to stack height) levitates the sheets in the supported sheet stack and assures separation of subsequent sheets from an acquired sheet, while vacuum at the plenum 102 is effective through ports 102*p*, 102*p*' (see FIG. 4) to cause the bottommost sheet from the stack to be acquired at the plenum for separation from the sheet stack.

The upper surface 102*a* of the plenum 102 of the receiver sheet feed head assembly 100 has a particularly configured shape (shown in cross-section in FIG. 5) so as to provide for a specific corrugation of an acquired receiver sheet. As the receiver sheets in the supported sheet stack are levitated, the bottommost sheet contacts the outer winged portions 102*b* of the surface 102*a*. Pressure is exerted on the opposed (cross-track) marginal edges of the receiver sheet stack by the adjustable guides 48, 50 to help in forming a controlled corrugation to the sheet. This establishes a consistent spacing for the center portion of the receiver sheet from the center portion of the plenum 102 (substantially coincident with the centerline $C_L$). Corrugation of the receiver sheet contorts the sheet in an unnatural manner. Since subsequent sheets are not subjected to the same forces, at the same time, as is the bottommost sheet, such subsequent sheets are unable to contort in the same manner. Accordingly, the subsequent sheets are effectively separated from the bottommost sheet as it is being acquired at the plenum 102.

In a preferred embodiment for efficiently handling typical receiver sheets, for use in an exemplary reproduction apparatus, of a weight and a size described above, the vacuum source V may create a flow rate in the range of approximately 30 cu. ft./min. A valve 108 (see FIG. 5), of the bleed-off, poppet or gravity door type for example, is used to limit the vacuum level once a sheet has been acquired at the plenum 102. Of course, alternatively, the vacuum source itself may be selected to provide a limit to the vacuum level which may be obtained. Limiting of the vacuum level aides in limiting air bleed through of some porous type sheet materials. Vacuum bleed through for a porous sheet may potentially cause the undesirable condition where a subsequent sheet will adhere to the acquired sheet and result in a multifeed. Additionally, limiting the vacuum level reduces the amount of energy required to transport the acquired sheet forward in the sheet feed direction. That is, the vacuum induced normal forces holding the sheet to the plenum 102 are reduced so that the sheet may be more readily transported, in the manner described hereinbelow, in the feed direction with substantially less drag.

It should also be noted that, according to this invention, the ports 102*p*' of the plenum 102, most closely adjacent the marginal edge of the sheets opposite to the marginal edges in engagement with the adjustable guide 46, are configured differently than the ports 102*p*. Such configuration is selected to restrict air flow in the immediate area. The purpose of such air flow limitation is to assure adequate attraction by the vacuum forces to acquire a sheet and feed an acquired sheet, while minimizing the attraction forces so as not to acquire more than one sheet even if the receiver sheets are of the pre-punched variety which have holes in the marginal edge which might otherwise allow acquisition of subsequent sheets (and result in a multifeed condition).

The receiver sheet feed head assembly 100 additionally includes a belt mechanism 104 for transporting an acquired receiver sheet in a feed direction (designated by the arrow B' in FIGS. 3 and 4) away from the sheet stack toward a downstream location. The belt transport mechanism 104 has a plurality of belts 104*a*, 104*b*, and 104*c* entrained about sets of rollers 108*a*, 108*b* to establish a closed loop path about the plenum 102. The upper runs of the belts 104*a*, 104*b*, and 104*c* are in intimate contact with the upper surface 102*a* of the plenum 102 (see FIG. 3). The acquired receiver sheet is effectively tacked to the belts 104*a*, 104*b*, and 104*c* by air pressure resulting from the application of vacuum in the plenum 102 through the plenum ports 102*p*, 102*p*' and the belt ports 104*p*.

The belts 104*a*, 104*b*, and 104*c* are selectively driven in a direction (clockwise in FIG. 3) to remove the acquired receiver sheet from the sheet stack and transport the sheet in the feed direction B' along a travel path to a downstream transport, such as driven feed nip roller pair 110. The nip roller pair 110 is driven by a motor $M_3$. The motor $M_3$ may also be used to provide the motive source for the belt transport mechanism 104 (of course, such drive may be provided by a separate motor if so desired). In the illustrated embodiment, the motor $M_3$ is coupled through a clutch 112 to a set of rollers 108*b* for the belts 104*a*, 104*b*, 104*c*. The clutch 112 is selectively activated to couple the motor to the roller set to provide for rotation of the belts at a desired time, as determined by the logic and control unit L, when an acquired receiver sheet should be fed from the hopper 42. Accordingly, when the clutch 112 is activated, the belts 104*a*, 104*b*, 104*c* will be driven so as to feed an acquired receiver sheet such that the acquired sheet is transported from the sheet stack and is thereafter available for any further processing, such as receiving a developed image from the dielectric support member web 12 of the reproduction apparatus 10.

The positive pressure air jet device 120 includes an air jet arrangement incorporating a plurality of nozzles 122 (preferably six in number) in common flow communication with the source of positive pressure air P. The nozzles 122 are aimed at the location where the bottom of the sheet stack will be positioned by the surface platform 42*a*. The purpose of the air jet device 120 is to separate any sheets adhering to the receiver sheet acquired by the sheet feed head assembly 100 for removal and transport from the hopper 42.

As discussed above, it has been found that subsequent sheets adhering to the acquired receiver sheet are not able to form the corrugations caused by the different ribs and bends of the upper surface 102*a* of the plenum 102 (as does the bottommost receiver sheet when properly acquired). Thus, pockets are formed between the topmost sheet and any subsequent adhering sheets. The air stream provided by the air jet device 120, by its location and aim, is directed into the pockets and forces the subsequent sheets back toward the sheet stack. As such, subsequent sheets are in effect retarded and thus substantially prevented from being fed with the acquired receiver sheet, as a multifeed condition. It should be noted that the louvers 54 in the adjustable guide 48 allow the air stream provided by the air jet device 120 to substantially freely pass from the hopper 42 so as to prevent a turbulent air flow adjacent the guide which might otherwise interfere with the intended separation purpose of the air stream provided by the air jet device.

In the preferred embodiment, the nozzles 122 of the second air jet arrangement 120 are angled approximately 30°±2° from the horizontal. The nozzles 122 have a substantially circular cross-sectional area (see FIG. 5). The air flow for the plurality of nozzles 122 is in the range of between 9–18 cu. ft./min. As will be discussed below, the air flow may be pulsed from an off or medium flow rate to a high flow rate (within the stated range).

A more detailed description of the operation of the vacuum corrugated duplex tray 40, according to this invention, will now be set forth. When the reproduction apparatus 10 is set for making duplex copies, any suitable mechanical or electrical sensing mechanism (not shown), associated with the receiver sheet supplies 22*a*, 22*b* will determine the dimensions (length and width) of the receiver sheets upon which the duplex copies are to be formed. The sensing mechanism provides appropriate signals to the logic and control unit L based on the determined receiver sheet dimensions. The logic and control unit L will then activate the stepper motors $M_1$ and $M_2$ to respectively adjust the positions of the adjustable guides 46 and 48, 50. As described above, activation of the motor $M_1$ will rotate the gear 60 in a selected direction for a predetermined number of steps, and the gear will walk along the rack 62 in the selected direction to cause the adjustable guide 46 to move a desired distance and direction to set the guide at a desired position for properly locating receiver sheets delivered to the hopper 42 relative to the feed head assembly 100. Similarly, activation of the motor $M_2$ will rotate the gear 90 in a selected direction for a predetermined number of steps, and the rotation of the gear 90 will be translated into corresponding movement of the adjustable guides 48, 50, in opposite directions equally about the receiver sheet center line $C_L$, to set the guides 48, 50 at a desired position for properly locating receiver sheets delivered to the hopper 42 relative to the center line $C_L$.

The reproduction apparatus 10 is now appropriately configured for making duplex copies and can then proceed to make duplex copies in the manner described above. Turning now to the timing chart for the operation of the vacuum corrugated duplex tray 40, shown in FIG. 12, the logic and control unit L (or an independent logic and control unit for the tray) provides for coordinated control of various functions of the tray during the duplex copy process. Particularly, the vacuum source V, the motor $M_2$, the air pressure source P, the clutch 112, and a sensor 134 at the nip rollers 110 are regulated for operation in a predetermined sequence. As receiver sheets are delivered by the nip rollers 44 to the hopper 42, at the beginning of each cycle $T_0$, the valve 108 turns on the vacuum to the plenum 102 of the receiver sheet feed head assembly 100; the motor $M_2$ is activated to oscillate the adjustable guides 48, 50 from the idle position away from the center line $C_L$; the air pressure source P is set to provide a minimum air flow; and the clutch 112 is turned off. Of course, the sensor 134 will not detect any sheet at this time.

At a subsequent time $T_1$, with the adjustable guides 48, 50 open, the air pressure source P is set to provide a maximum air flow to enable the bottommost receiver sheet in the stack on the surface platform 42*a* to be separated from the remainder of the stack for corrugation and acquisition by the feed head assembly 100. After sufficient time for sheet acquisition, at a time $T_2$, the clutch 112 is activated to drive the belt transport mechanism 104 and feed the bottommost receiver sheet out from the stack in the direction B' to the nip rollers 110.

At a time $T_4$, slightly after the lead edge of the fed sheet is detected by the sensor 134 (at the time $T_3$) as being in the nip rollers 110, the valve 108 shuts off the vacuum source V, and the clutch 112 is deactivated. This enables the receiver sheet to be advanced by the nip rollers without any undue forces on the sheet due to the vacuum or feed belts. At a time $T_5$, subsequent to time $T_4$, the motor $M_2$ is activated to oscillate the adjustable guides 48, 50 from the idle position toward the center line $C_L$ to effect jogging of the sheets in the stack on the surface platform 42*a* of the hopper 42. The cycle is then ready to be repeated for the desired number of duplex copies to be made by the reproduction apparatus 10.

The invention has been described in detail with particular reference to preferred embodiment thereof, but it will be understood that variations and modifications can be effected within the spirit and scope of the invention as set forth in the claims.

What is claimed is:

1. In a reproduction apparatus capable of making duplex copies, a vacuum corrugated duplex tray for receiving discrete receiver sheets, to form a stack of discrete receiver sheets, and subsequently feed said receiver sheets seriatim away-from such formed stack, said vacuum corrugated duplex tray comprising:

a hopper adapted to support a stack of receiver sheets, said hopper including a surface platform supporting said stack of receiver sheets, said surface platform having a portion of corrugated shape, in cross-section, to effect a similar corrugation of a receiver sheet in contact therewith, means for defining a first stop for a first common marginal edge of the receiver sheets, and means for defining opposed second and third stops for opposed common marginal edges of the receiver sheets, such opposed marginal edges being respectively perpendicular to said first marginal edge of a receiver sheet;

means for delivering the receiver sheets seriatim in a first direction to the vicinity of said hopper into engagement with said first stop defining means;

at least one dangler connected respectively to said second and third stop defining means, said at least one dangler being configured to ramp up on a stack of sheets supported on said surface platform, delivered by said delivering means in the first direction, into engagement with said first stop defining means to form a stack of receiver sheets on said surface platform;

means for urging the receiver sheets seriatim in a direction opposite said first direction to remove the receiver sheets seriatim from the stack on said surface platform; and means connected to said second and third stop defining means for locating said second and third stop defining means so as to accurately position the stack of receiver sheets on said surface platform and aid in separating adjacent sheets in said stack, and for substantially simultaneously oscillating said second and third stop defining means to maintain such stack in the accurate position as such receiver sheets are urged to and from said stack on said surface platform.

2. The vacuum corrugated duplex tray of claim 1 wherein said surface platform includes a substantially planer surface upon which the receiver sheets are stacked, said substantially planer surface is oriented to lie at an angle of approximately 4° with respect to the horizontal, with increasing elevation occurring in the direction opposite the first direction.

3. The vacuum corrugated duplex tray of claim 2 wherein said means for defining said first stop includes a first guide oriented substantially perpendicular to said surface platform, said first guide being adjustable, relative to said surface platform, in a direction coincident with said first direction to enable said surface platform to accommodate receiver sheet stacks of different dimensions in such first direction.

4. The vacuum corrugated duplex tray of claim 3 wherein said means for urging receiver sheets seriatim in a direction opposite said first direction to remove receiver sheets from a sheet stack includes at least one movable belt located adjacent to said portion of said surface platform of corrugated shape so as to have a run lying coincident with said direction opposite said first direction, means for creating a vacuum in said portion of said surface platform of corrugated shape to urge a receiver sheet into engagement with said at least one belt, and means for generating a positive flow of air at the edge of said stack opposite to the edge engaging said first stop defining means to separate receiver sheets in said stack.

5. The vacuum corrugated duplex tray of claim 4 wherein said portion of said surface platform of said hopper of corrugated shape includes a series of ports configured to include substantially triangular ports for controlling air flow.

6. The vacuum corrugated duplex tray of claim 1 wherein said means for locating said second and third stop defining means and for substantially simultaneously oscillating said second and third stop defining means includes a stepper motor simultaneously driving said second and third stop defining means a substantially equal distance from the centerline of sheet feed for centering a stack of sheets on said surface platform of said hopper.

7. The vacuum corrugated duplex tray of claim 6 wherein said stepper motor selectively simultaneously drives said second and third stop defining means a substantially equal distance from the centerline of sheet feed less than one half the dimension of the stack of sheets in order to buckle such sheets to aid in separation and acquisition of such sheets.

8. The vacuum corrugated duplex tray of claim 7 wherein said stepper motor is configured to stall when said stack of sheets becomes too great.

9. The vacuum corrugated duplex tray of claim 6 wherein said stepper motor selectively simultaneously drives said second and third stop defining means a substantially equal distance from the centerline of sheet feed greater than one half the dimension of the stack of sheets in order to open said second and third stop defining means on sheet delivery to decrease drag on said sheets by said second and third stop defining means.

10. The vacuum corrugated duplex tray of claim 6 wherein said stepper motor selectively simultaneously drives said second and third stop defining means a substantially equal distance from the centerline of sheet feed less than one half the dimension of the stack of sheets in order to buckle such sheets to aid in separation and acquisition of such sheets, said stepper motor selectively simultaneously drives said second and third stop defining means a substantially equal distance from the centerline of sheet feed greater than one half the dimension of the stack of sheets in order to open said second and third stop defining means on sheet delivery to decrease drag on said sheets by said second and third stop defining means, and wherein said stepper motor is configured to stall when said stack of sheets becomes too great.

* * * * *